US009797295B2

(12) United States Patent
Almkvist et al.

(10) Patent No.: US 9,797,295 B2
(45) Date of Patent: Oct. 24, 2017

(54) ARRANGEMENT AND A CONTROL METHOD OF AN ENGINE COOLING SYSTEM

(71) Applicant: VOLVO CAR CORPORATION, Gothenburg (SE)

(72) Inventors: Goran Almkvist, Lerum (SE); Jonas Bjorkholtz, Karna (SE); Stefan Sundemo, Angered (SE)

(73) Assignee: VOLVO CAR CORPORATION (SE)

( * ) Notice: Subject to any disclaimer, the term of this patent is extended or adjusted under 35 U.S.C. 154(b) by 99 days.

(21) Appl. No.: 14/847,547

(22) Filed: Sep. 8, 2015

(65) Prior Publication Data

US 2016/0084146 A1 Mar. 24, 2016

(30) Foreign Application Priority Data

Sep. 18, 2014 (EP) ..... 14185243

(51) Int. Cl.
*F01P 7/16* (2006.01)
*F01P 11/04* (2006.01)
(Continued)

(52) U.S. Cl.
CPC ..... *F01P 7/165* (2013.01); *F01P 7/161* (2013.01); *F01P 11/04* (2013.01);
(Continued)

(58) Field of Classification Search
CPC ..... F01P 7/165; F01P 3/20; F01P 2007/146; F01P 7/16; F01P 2050/06; F01P 2060/00; F01P 2003/182; F01P 2003/185
See application file for complete search history.

(56) References Cited

U.S. PATENT DOCUMENTS 5,215,044 A * 6/1993 Banzhaf ..... F01P 3/20 123/41.05
5,558,055 A * 9/1996 Schatz ..... B60H 1/00492 123/142.5 R
(Continued)

FOREIGN PATENT DOCUMENTS

DE 102012205001 A1 8/2013
EP 0499071 A1 8/1992
(Continued)

OTHER PUBLICATIONS

Non-English Language Reference, Corresponding English Language Information.
(Continued)

*Primary Examiner* — Long T Tran
(74) *Attorney, Agent, or Firm* — Brooks Kushman P.C.

(57) ABSTRACT

An engine cooling system in a vehicle comprises a first coolant circuit and a second coolant circuit connecting an engine to a radiator. A thermostat is arranged in the first coolant circuit and is arranged to be closed during engine warm-up, to prevent flow through the first coolant circuit. The cooling system further comprises a bypass circuit connecting the thermostat to the second coolant circuit and at least one parallel circuit. Each parallel circuit is connected to the second coolant circuit upstream of the bypass circuit, wherein a partial coolant flow is directed from the bypass circuit and upstream through the second coolant circuit into the at least one parallel circuit during engine warm-up. The disclosure further relates to a method for controlling such an engine cooling system.

20 Claims, 7 Drawing Sheets

(51) Int. Cl.
*F01P 5/10* (2006.01)
*F01P 7/14* (2006.01)
*F02M 26/22* (2016.01)

(52) U.S. Cl.
CPC ..... *F01N 2260/024* (2013.01); *F01P 7/164* (2013.01); *F01P 2005/105* (2013.01); *F01P 2007/143* (2013.01); *F01P 2007/146* (2013.01); *F01P 2037/02* (2013.01); *F01P 2060/045* (2013.01); *F01P 2060/16* (2013.01); *F02M 26/22* (2016.02)

(56) References Cited

U.S. PATENT DOCUMENTS 6,722,147 B2 * 4/2004 Heyl ..... B60H 1/00907 62/244
6,899,162 B2 * 5/2005 Hohl ..... F01P 7/165 123/41.29
2002/0121554 A1 * 9/2002 Vaudry ..... F01P 5/10 236/34
2005/0072174 A1 * 4/2005 Beers ..... B63J 2/04 62/228.1
2009/0255488 A1 * 10/2009 Shiobara ..... F01P 7/167 123/41.1
2013/0312418 A1 * 11/2013 Kardos ..... F01N 5/02 60/668

FOREIGN PATENT DOCUMENTS

EP 1995424 A2 11/2008
WO 2014102122 A1 7/2014

OTHER PUBLICATIONS

Extended European Search Report dated Mar. 6, 2015, Application No. 14185243.4-1606, Applicant Volvo Car Corporation, 7 Pages.

* cited by examiner

ARRANGEMENT AND A CONTROL METHOD OF AN ENGINE COOLING SYSTEM

CROSS-REFERENCE TO RELATED APPLICATIONS

This application claims foreign priority benefits under 35 U.S.C. §119(a)-(d) to European patent application number EP 14185243.4, filed Sep. 18, 2014, which is incorporated by reference in its entirety.

TECHNICAL FIELD

The present disclosure relates to an arrangement and a control method of an engine cooling system, in particular to a control method of an engine rapid warm-up system that effectively warms up an engine by allowing cooling water to bypass a radiator during an engine start while at the same time allowing temperature control for selected components.

BACKGROUND

In general, in a water cooled engine of a motor vehicle, the engine is connected to a radiator by a cooling water circuit. Cooling water that is cooled down by a radiator is supplied to the water cooled engine through a cooling water supply passage, and the cooling water that is heated by the engine is returned through the cooling water return passage to the radiator, where the cooling water is cooled down due to heat transfer between the cooling water and the open air.

In such a water cooled engine, there is a problem in that startability of the engine deteriorates because the engine is cooled down to the same temperature as the outside air temperature while a motor vehicle is parked during the winter season and in a cold region. In addition, there is another problem in that fuel efficiency thereof decreases because it takes time to rise the temperature of the engine up to an appropriate one at cold start of the engine. For instance, in an engine equipped with an electronic fuel injection system, the engine is maintained to run in a state where idle speed thereof is high, so that the fuel efficiency deteriorates. In order to shorten the time required for the engine to reach a desired operating temperature, the radiator can be bypassed so that the cooling water is prevented from being cooled during a cold start.

At the same time, the function of other components connected to the coolant circuit, such as heat exchangers for an exhaust gas recirculation (EGR) system, a transmission connected to the engine or a catalytic converter, such as a selective catalytic reduction (SCR) device, for exhaust after-treatment can have different cooling requirements during a cold start and normal operation. For instance, relatively cold coolant flowing through an SCR heat exchanger or a transmission cooler during a cold start will delay the point in time when such components reach their operating temperature. However, after a cold start the same components can require effective cooling.

SUMMARY

An object of the disclosure is to provide an improved arrangement and a method for controlling the flow of cooling water during an engine cold start and a cooling system which eliminates the above problems. The object is achieved by an engine cooling system and a method for controlling the flow of coolant during engine warm-up according to the disclosure.

The disclosure relates to an engine cooling system in a vehicle, which cooling system can be used for cooling the engine and any powertrain component associated with the engine and connected to the cooling system. The coolant is preferably, but not necessarily, water and can contain commonly used additives for preventing freezing and oxidation.

According to a preferred embodiment, the engine cooling system comprises a first coolant circuit connecting a coolant outlet of the engine to a radiator, a thermostat arranged in the first coolant circuit, which thermostat is arranged to be closed during engine warm-up, thereby preventing flow through the first coolant circuit, and a second coolant circuit connecting the radiator to a coolant inlet of the engine. A coolant pump is provided for circulating coolant through the cooling system. The coolant pump is preferably, but not necessarily arranged in the second coolant circuit and can be driven directly by the engine or indirectly by, for instance, electric or hydraulic means. In this context, the terms "circuit" and "coolant circuit" are used to describe suitable means for conveying coolant through an engine or a powertrain cooling system.

The cooling system further comprises a bypass circuit connecting the thermostat to the second coolant circuit, bypassing the radiator. In the inventive system the thermostat is closed during an engine warm-up mode, i.e., when starting a cold engine (cold start), wherein the coolant flow supplied by the coolant pump flows through the bypass circuit. This will prevent cooling of the coolant in the radiator during the engine warm-up mode. When the engine is started, the coolant temperature will immediately begin to increase as the coolant flowing through the engine is heated by the heat generated in the combustion chambers.

The thermostat used is preferably a low temperature thermostat that will open at a relatively lower set temperature than a conventional thermostat. In a conventional cooling system the thermostat will open at approximately 90° C., whereby the coolant flow will pass from the engine and directly into the first coolant circuit to be cooled in the radiator. The disclosure advantageously uses a low temperature thermostat which opens at a coolant temperature 10-15° C. below the opening temperature of a conventional thermostat, i.e., at a temperature of 75-80° C. Advantages of using a low temperature thermostat includes improved engine cooling at maximum power operation of the engine, resulting in reduced NOx emissions during hot ambient conditions and high speed accelerations.

The cooling system further comprises at least one parallel circuit, each comprising a heat exchanger, where each parallel circuit is connected to the second coolant circuit upstream of the bypass circuit. While the thermostat is closed, a partial coolant flow is directed from the bypass circuit and upstream through the second coolant circuit into the at least one parallel circuit during engine warm-up. A flow controlling device will restrict the coolant flow from the bypass circuit and downstream into the second coolant circuit. A part of the coolant flow will instead be forced through the at least one parallel circuit.

This arrangement causes a reverse flow over a portion of the second coolant circuit, from the connection between the bypass circuit and the second coolant circuit to the connection between the at least one parallel circuit and the second coolant circuit. This counter flow prevents cold coolant in the second coolant circuit in or downstream of the radiator and upstream of the at least one parallel circuit from being drawn towards the engine while the thermostat is closed. Each parallel circuit is provided with a heat exchanger that is arranged for selectively heating or cooling a powertrain component under different operating conditions. According to one example, a first parallel circuit comprises an exhaust gas recirculation (EGR) heat exchanger. During engine warm-up the coolant the rapidly heated coolant passes through the EGR heat exchanger, whereby the EGR is prevented from sticking and the heat exchanger is prevented from freezing in cold ambient conditions. Once the thermostat opens, the coolant will be cooled in the radiator and cools the exhaust passing through the EGR heat exchanger. According to a further example, a second parallel circuit comprises a catalytic converter heat exchanger for heating e.g., a selective catalytic reduction (SCR) device. The SCR device is an advanced active emissions control system that injects a liquid-reductant agent through a special catalyst into the exhaust stream of a diesel engine. The reductant source is usually automotive-grade urea, otherwise known as Diesel Exhaust Fluid (DEF). The DEF sets off a chemical reaction that converts nitrogen oxides into nitrogen, water and tiny amounts of carbon dioxide (CO2). During engine warm-up the coolant the rapidly heated coolant passes through the SCR heat exchanger, whereby the heat exchanger can reach its operating temperature in a shorter time. Once the thermostat opens, the coolant will be cooled in the radiator and cools the exhaust passing through the SCR heat exchanger to assist in maintaining a preferred operating temperature and to prevent it from being excessively heated. According to a further example, a third parallel circuit comprises a transmission oil heat exchanger. A parallel circuit comprising a transmission oil heat exchanger can also comprise a controllable valve. This valve can be open while the thermostat is closed, in order to assist in heating the transmission, and be closed when the thermostat opens, in order to stop cold coolant from the radiator to cool the transmission unnecessarily. A cooling system according to the disclosure can comprise any such heat exchanger, singly or in combination.

A flow controlling device is arranged to direct a partial coolant flow from the bypass circuit, upstream through the second coolant circuit and into the at least one parallel circuit. The flow controlling device can be a flow restricting device located in the second coolant circuit downstream of the bypass circuit. The device can be a controllable/variable flow or a fixed flow throttle valve or a similar suitable device for limiting the flow rate in the second coolant intermediate the inlet and outlet of the at least one parallel circuit. The coolant flowing through the one or more parallel circuits is returned to the second coolant circuit downstream of the flow controlling device. Alternatively, the flow controlling device can be a second coolant pump arranged in the at least one parallel circuit. Preferably, the second coolant pump is arranged in the at least one parallel circuit upstream of the bypass circuit. The coolant flowing through the one or more parallel circuits is returned to the second coolant circuit downstream of the bypass circuit. According to a further alternative, the flow controlling device can comprise a combination of a flow restricting device and a second coolant pump as described above.

The cooling system can further comprise a third coolant circuit connecting the coolant pump to an engine oil heat exchanger, or oil cooler. In addition, a fourth coolant circuit can be provided for connecting the engine oil cooler to the second coolant circuit. The fourth coolant circuit can be connected to the second coolant circuit upstream of the flow controlling device, preferably upstream of the bypass circuit and downstream of the at least one parallel circuit. Alternatively, the fourth coolant circuit can be connected to the second coolant circuit downstream of an at least one parallel circuit comprising a second coolant pump, preferably upstream of the bypass circuit and downstream of the at least one parallel circuit. The third coolant circuit can comprise a controllable valve. This controllable valve can be open while the thermostat is closed, in order to assist in heating the engine oil, and be closed when the thermostat opens, in order to increase the oil temperature towards a desired operating temperature.

As described above, each parallel circuit is provided with a heat exchanger. One or more parallel circuits can also be provided with a throttle valve. At least one such throttle valve can be a fixed flow valve arranged to balance the coolant flow through the second coolant circuit upstream of the bypass circuit and the at least one parallel circuit.

In the case where the flow controlling device is a throttle valve, the throttle valve in the second coolant circuit and/or each throttle valve in a parallel circuit can be pre-set to allow predetermined flow rates for the throttle valves in the second coolant circuit and each individual heat exchanger, respectively. The flow rate through each parallel circuit is determined by the heating and cooling requirements for each respective component connected to a heat exchanger in a parallel circuit.

Alternatively, at least one throttle valve is a controllable flow valve arranged to balance the coolant flow through second coolant circuit and the at least one parallel circuit. In this case, the throttle valve in the second coolant circuit and/or each throttle valve in a parallel circuit can be adjusted in steps or continuously to adapt the flow rate for the throttle valve in the second coolant circuit and each individual heat exchanger dependent on the current heating or cooling requirements for each respective component connected to a heat exchanger.

According to a further alternative, any one of the throttle valve in the second coolant circuit and the respective throttle valve in each parallel circuit can be either a fixed flow valve or a controllable flow valve.

In an alternative version of the above example, each parallel circuit is provided with a heat exchanger without an associated throttle valve. In this case, the dimensions of each parallel circuit can be selected to balance the coolant flow through the second coolant circuit upstream of the bypass circuit and the at least one parallel circuit. Hence, if a heat exchanger in a first parallel circuit requires a greater coolant flow than the heat exchangers in the other parallel circuits then the conduit making up the first parallel circuit is given a larger cross-section to allow a greater flow rate through that parallel circuit. In this way, the cross-section of the conduits in each parallel circuit can be dimensioned to the heating and cooling requirements for each respective component connected to a heat exchanger in a parallel circuit.

Within the scope of the disclosure it is possible to provide multiple parallel circuits having a combination of no throttle valves, fixed throttle valves and/or controllable flow valves.

According to a first alternative example, the engine cooling system described above further comprises a second coolant pump arranged to control the coolant flow through the at least one parallel circuit. The second coolant pump is a controllable pump located in the inlet of the at least one parallel circuit, adjacent the connection to the second coolant circuit. In this way the flow rate through each parallel circuit is controllable by a throttle valve in the respective parallel circuit and the second coolant pump. The pump can be adjusted in steps or continuously to adapt the flow rate for the throttle valve in the second coolant circuit and each individual heat exchanger dependent on the current heating or cooling requirements for each respective component connected to a heat exchanger. The provision of a coolant pump for the at least one parallel circuit does not require a throttle valve in the second coolant circuit upstream of the bypass circuit. Hence, when a second coolant pump is used, a throttle valve or a similar flow restricting device in the second coolant circuit is optional.

According to a second alternative example, the engine cooling system described above further comprises a controllable thermostat in the first coolant circuit connecting the coolant outlet of the engine to the radiator. As the temperature of the coolant leaving the engine increases towards a desired coolant temperature, the thermostat can be partially opened to provide a leakage flow through the radiator. This will provide the EGR heat exchanger with cold coolant from the relatively cold portion of the coolant circuit comprising the radiator. In this way the NOx-emissions from the engine can be reduced when the engine approaches its normal operating temperature. The thermostat will then be gradually opened as the coolant temperature increases, until it is fully open at its predetermined set temperature. The set temperature of the thermostat can subsequently be adjusted up or down dependent on current cooling requirements.

This second example is preferably, but not necessarily, combined with a second coolant pump as described in the first alternative example. The provision of a second coolant pump allows the flow rate through the EGR heat exchanger to be controlled accurately.

According to a third alternative example, the engine cooling system described in the first alternative example above further comprises an alternative coolant return circuit. The alternative coolant return circuit is connected to the at least one parallel circuit downstream of the one or more heat exchangers and returns a partial coolant flow to the first coolant circuit downstream of the thermostat and upstream of the radiator. A valve is provided in the alternative coolant return circuit, which valve can be opened prior to the opening of the thermostat to provide a leakage flow through the radiator. The valve can be either a fixed flow valve or a controllable flow valve. This will provide the EGR heat exchanger with cold coolant from the relatively cold portion of the coolant circuit comprising the radiator. In this way the NOx-emissions from the engine can be reduced when the engine approaches its normal operating temperature. This third example provides an alternative to the second alternative example, wherein the alternative coolant return circuit replaces a controllable thermostat.

According to a fourth alternative example, the engine cooling system according to the preferred embodiment described above comprises an alternative flow controlling device, replacing the throttle valve in the second coolant circuit downstream of the bypass circuit. The alternative flow controlling device comprises a reduced flow circuit with a bypass circuit comprising a controllable valve. During a cold start, the controllable valve is closed and a partial coolant flow is directed through the reduced flow circuit, which circuit has the same function as the throttle valve described above. The flow restriction function can be achieved either by the use of a throttle valve or by a conduit having a reduced cross-sectional area suitable for limiting the flow rate in the reduced flow circuit. When the engine reaches its desired operating temperature; when the thermostat opens; and/or when a predetermined operation condition is fulfilled, the controllable valve can be opened to allow full flow of coolant through the bypass portion of the second coolant circuit.

This fourth example can be combined with a second coolant pump as described in the first alternative example. The provision of a second coolant pump allows at least a minimum flow rate through at least the EGR heat exchanger to be maintained even if the valve in the second coolant circuit is fully open.

The flow controlling features described above can be combined to provide the desired heating or cooling of the engine and its associated transmission components. Hence, the flow controlling device used for directing coolant into one or more parallel circuits can comprise a fixed or controllable flow throttle valve, which throttle valve can be used alone or in combination with a second coolant pump arranged to supply coolant to the one or more parallel circuits. Similarly, the second coolant pump can be used alone or in combination with the said throttle valve. When a leakage flow through the radiator is desired prior to the full opening of the thermostat, e.g., for cooling the EGR heat exchanger, the above examples can be combined with a controllable thermostat or a valve controlled bypass circuit connecting the outlet of the heat exchangers in the parallel circuits with the first coolant conduit.

The disclosure further relates to a vehicle provided with an engine cooling system as described in the above examples.

The disclosure also relates to a method for controlling an engine cooling system comprising a first coolant circuit connecting a coolant outlet of the engine to a radiator, a thermostat arranged in the first coolant circuit, which thermostat is arranged to be closed if the coolant temperature is below a predetermined limit, a second coolant circuit connecting the radiator to a coolant inlet of the engine, a coolant pump for circulating coolant through the cooling system, a bypass circuit connecting the thermostat to the second coolant circuit and at least one parallel circuit comprising a heat exchanger, which parallel circuit is connected to the second coolant circuit with an inlet upstream of the bypass circuit and an outlet downstream of the bypass circuit. An engine cooling system of this type has been described in the above text.

The method involves performing the following steps, during an engine warm-up mode:

maintaining the thermostat in a closed position, thereby preventing flow through the first coolant circuit, supplying coolant flow through the bypass circuit when the thermostat is closed;

maintaining a partial coolant flow from the bypass circuit and downstream through the second coolant circuit; and maintaining a partial coolant flow directed from the bypass circuit and upstream through the second coolant circuit into the at least one parallel circuit.

During engine warm-up operation the method can involve maintaining a partial coolant flow through a parallel circuit comprising one or more of an exhaust gas recirculation heat exchanger, a catalytic converter heat exchanger or a transmission oil heat exchanger. The coolant flowing through the one or more parallel circuits is returned to the second coolant circuit downstream of the bypass circuit.

Coolant flow through a parallel circuit comprising a transmission oil heat exchanger can be controlled by opening a controllable valve in the parallel circuit when the thermostat is closed and closing the controllable valve in the parallel circuit for the transmission oil heat exchanger when the thermostat is open.

The cooling system can further comprise a third coolant circuit connecting the coolant pump to an engine oil heat exchanger, or oil cooler. Coolant flow through the third coolant circuit can be controlled by opening a controllable valve in a third coolant circuit connecting the coolant pump to an engine oil cooler when the thermostat is closed.

A flow controlling device is arranged to direct a partial coolant flow from the bypass circuit, upstream through the second coolant circuit and into the at least one parallel circuit. According to one example, the flow controlling device can be a flow restricting device, such as a throttle valve, located in the second coolant circuit downstream of the bypass circuit. Coolant flow through the throttle valve in the second coolant circuit and the respective throttle valve in each parallel circuit can be controlled by balancing the coolant flow through the throttle valves in the second coolant circuit and each parallel circuit using at least one fixed flow throttle valve. Alternatively, the coolant flow can be balanced by using at least one controllable flow throttle valve. According to a further alternative, the coolant flow through any one of the throttle valve in the second coolant circuit and the throttle valve in each parallel circuit can be controlled by either a fixed flow valve or a controllable flow valve.

In an alternative version of the above example, each parallel circuit can be provided with a heat exchanger without an associated throttle valve. In this case, the dimensions of each parallel circuit can be selected to balance the coolant flow through the second coolant circuit upstream of the bypass circuit and the at least one parallel circuit.

According to a further example, the flow controlling device can be a second coolant pump arranged in the at least one parallel circuit. Preferably, the second coolant pump is arranged in the at least one parallel circuit upstream of the bypass circuit. The coolant flowing through the one or more parallel circuits is returned to the second coolant circuit downstream of the bypass circuit. According to a further alternative, the flow controlling device can comprise a combination of a flow restricting device and a second coolant pump.

According to a further example, the flow controlling device comprises a controllable valve with a reduced flow bypass circuit, wherein the controllable valve is opened when a predetermined operation condition is fulfilled. This condition can be related to the engine coolant temperature. Further examples of a predetermined condition can be related to one or more of the engine oil temperature, a detected coolant temperature in one or more heat exchangers or a detected temperature in a component associated with heat exchanger.

Under some conditions it can be advantageous to allow a reduced coolant flow through the radiator into the second coolant circuit. According to a first example, this can be achieved by providing a controllable thermostat. In this example the method involves controlling the thermostat by partially opening it when a predetermined second coolant temperature is reached, which temperature is lower than the first coolant temperature.

According to a second example, a reduced coolant flow through the radiator can be achieved by providing a coolant return circuit comprising a controllable valve connected to the at least one parallel circuit downstream of the one or more heat exchangers, wherein the controllable valve is opened to return a partial coolant flow to the first coolant circuit when a predetermined second coolant temperature is reached, which temperature is lower than the first coolant temperature.

The control method according to the disclosure, allows the engine and the engine oil to be heated at an increased rate during engine warm-up operation, when the thermostat is closed. At the same time, powertrain components, such as the transmission or a catalytic converter heat exchanger e.g., a selective catalytic reduction (SCR) device, can reach their operating temperatures more rapidly. Other components, such as an exhaust gas recirculation (EGR) cooler can be heated during engine warm-up in order to prevent it from freezing at low ambient temperatures. Therefore, the relatively high temperature coolant can accelerate the warm-up of the engine, so that the engine and a number of powertrain components can be brought up to their desired operating temperature at an increased rate during the winter season and in cold regions.

After the end of an engine warm-up operation, when the thermostat opens, the heat exchangers in the parallel circuits will be supplied with relatively cold coolant from the radiator which allows selected powertrain components to be cooled under normal operating conditions. A SCR device can be cooled to maintain a desired operating temperature and to prevent overheating that could damage the device. An EGR cooler can be supplied to reduce the temperature of hot recirculated exhaust gas supplied to the engine air intake. Other components, such as the transmission can be provided with a controllable valve that closes when the thermostat opens. In this way the transmission will not be cooled by the coolant from the radiator after the warm-up period, but will continue to be heated towards a desired operating temperature. The transmission temperature can then be controlled by operating the controllable valve.

Further advantages and advantageous features of the disclosure are disclosed in the following description.

BRIEF DESCRIPTION OF THE DRAWINGS

With reference to the appended drawings, below follows a more detailed description of embodiments according to the disclosure cited as examples. In the drawings.

DETAILED DESCRIPTION

As required, detailed embodiments are disclosed herein; however, it is to be understood that the disclosed embodiments are merely exemplary and that various and alternative forms may be employed. The figures are not necessarily to scale. Some features may be exaggerated or minimized to show details of particular components. Therefore, specific structural and functional details disclosed herein are not to be interpreted as limiting, but merely as a representative basis for teaching one skilled in the art.

Figure 1:
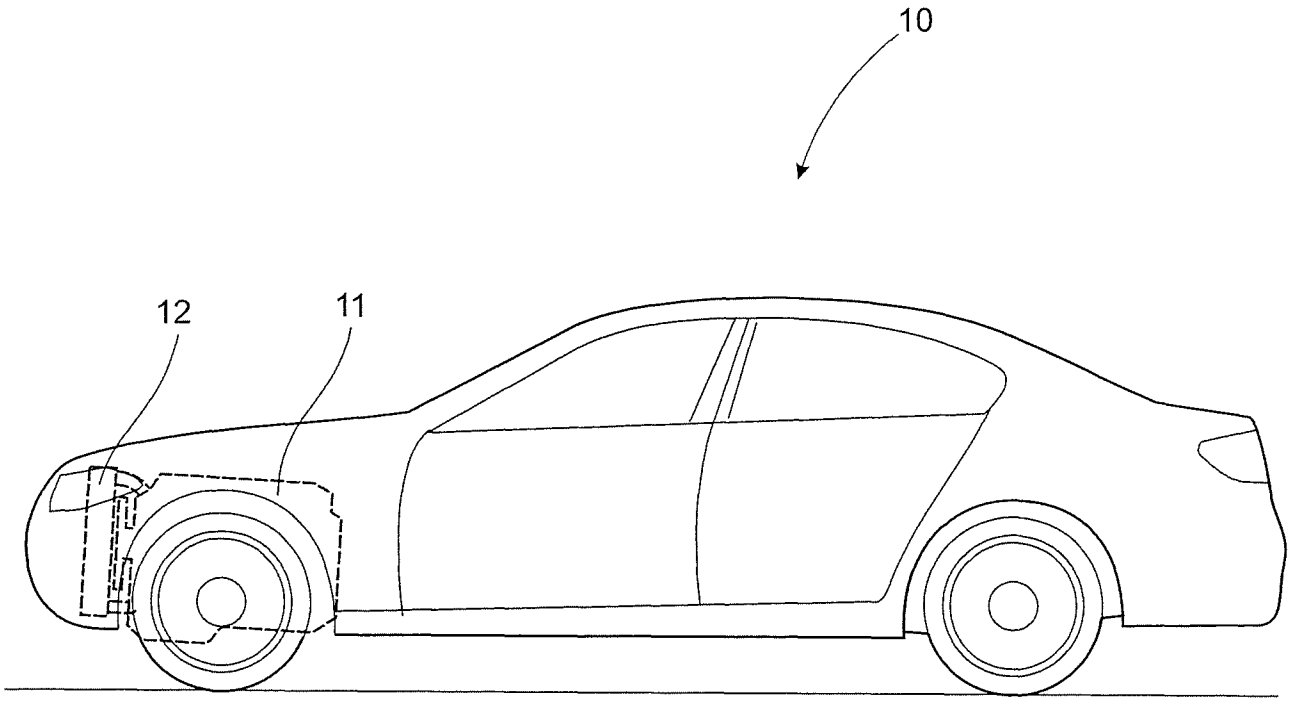
FIG. 1 shows a schematically illustrated vehicle provided with an engine cooling system according to the disclosure.

FIG. 1 shows a schematically illustrated vehicle provided with an engine cooling system according to the disclosure. The figure shows a vehicle 10 provided with an internal combustion engine 11, connected to a radiator 12.

Figure 2A:
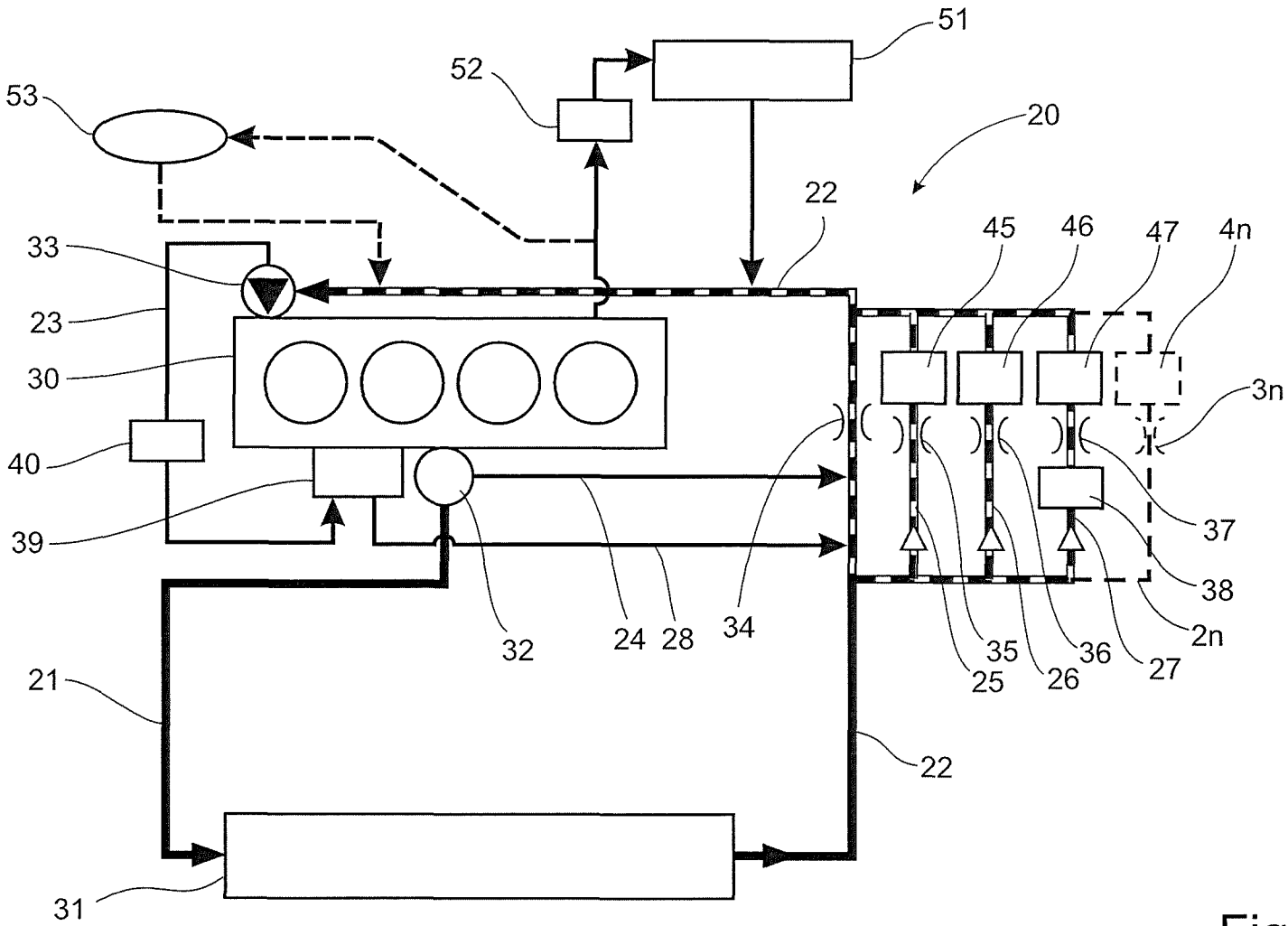
FIG. 2A shows a schematically illustrated engine cooling system according to the disclosure.

FIG. 2A shows a first schematically illustrated engine cooling system 20. The engine cooling system 20 comprises a first coolant circuit 21 connecting a coolant outlet of an engine 30 to a radiator 31, a thermostat 32 arranged in the first coolant circuit 21, which thermostat 32 is arranged to be closed during engine warm-up, thereby preventing flow through the first coolant circuit, and a second coolant circuit 22 connecting the radiator to a coolant inlet of the engine 30. Throughout the figure, the direction of flow is indicated by arrows. A coolant pump 33 is provided for circulating coolant through the cooling system 20. The coolant pump 33 is arranged in the second coolant circuit 22 and is driven directly by the engine 30, for instance, electric or hydraulic means (not shown). In this context, the terms "circuit" and "coolant circuit" are used to describe suitable means for conveying coolant through an engine or a powertrain cooling system.

The cooling system further comprises a bypass circuit 24 connecting the thermostat to the second coolant circuit 22 upstream of a first throttle valve 34. In this example the thermostat 32 is closed during an engine warm-up mode, i.e., when starting a cold engine, wherein the coolant flow supplied by the coolant pump 33 flows through the bypass circuit 24. This will prevent cooling of the coolant in the radiator 31 during the engine warm-up mode. When the engine 30 is started, the coolant temperature will immediately begin to increase as the coolant flowing through the engine 30 is heated by the heat generated in the combustion chambers.

The thermostat 32 is a low temperature thermostat that will open at a relatively lower temperature. In a conventional cooling system the thermostat will open at approximately 90° C., whereby the coolant flow will pass from the engine and directly into a main coolant circuit to be cooled in the radiator. In this case, the low temperature thermostat 32 opens at a temperature of 75-80° C.

The cooling system 20 further comprises a number of parallel circuits 25, 26, 27, 2*n*, each comprising a throttle valve 35, 36, 37, 3*n* and a heat exchanger 45, 46, 47, 4*n*, respectively. Each parallel circuit 25, 26, 27, 2*n* is connected to the second coolant circuit 22 at a common location upstream of the bypass circuit 24 and downstream of the first throttle valve 34. While the thermostat is closed, a partial coolant flow is directed from the bypass circuit 24 and upstream through the second coolant circuit 22 into the parallel circuits 25, 26, 27, 2*n* during engine warm-up. The throttle valve 34 in the secondary circuit 22 will restrict the coolant flow from the bypass circuit 24 and force a part of the coolant flow through the parallel circuits 25, 26, 27, 2*n*. This arrangement causes a reverse flow over a portion of the second coolant circuit 22, between the connection with the bypass circuit 24 and the connection of the parallel circuits 25, 26, 27, 2*n*. This counter flow prevents cold coolant in the second coolant circuit 22 in or downstream of the radiator 31 and upstream of the parallel circuits 25, 26, 27, 2*n* from being drawn towards the coolant pump 33 and the engine 30. The coolant flow in the second coolant circuit 22 and the parallel circuits 25, 26, 27 during engine warm-up is indicated with dashed lines in the respective circuit. The coolant flowing through the parallel circuits 25, 26, 27, 2*n* is returned to the second coolant circuit 22 downstream of the first throttle valve 34.

Each parallel circuit 25, 26, 27, 2*n* is provided with a heat exchanger 45, 46, 47, 4*n* that is arranged for selectively heating or cooling a powertrain component (not shown). According this example, a first parallel circuit 25 comprises an exhaust gas recirculation EGR heat exchanger 45. A second parallel circuit 26 comprises a catalytic converter heat exchanger 46 for heating e.g., a selective catalytic reduction (SCR) device. A third parallel circuit 27 comprises a transmission oil heat exchanger 47. The parallel circuit 27 comprising the transmission oil heat exchanger 47 also comprises a controllable valve 38. This valve 38 is open while the thermostat 32 is closed, in order to assist in heating the transmission, and is closed when the thermostat 32 opens, in order to stop cold coolant from the radiator 31 to cool the transmission unnecessarily. By heating the transmission oil friction is reduced and gearshift quality and fuel economy is improved. During engine warm-up, the active heating of the transmission will have a greater effect of the fuel consumption than the heating of the engine itself.

A cooling system 20 according to the disclosure can comprise further parallel circuits 2*n* comprising a throttle valve 3*n* and a heat exchanger 4*n*, as indicated by dashed lines in FIG. 2A.

The cooling system 20 further comprises a third coolant circuit 23 connecting the coolant pump 33 to an engine oil heat exchanger 39, often termed oil cooler. In addition, a fourth coolant circuit 28 is provided for connecting the engine oil cooler 39 to the second coolant circuit 22 upstream of the first throttle valve 34 and downstream of the parallel circuits 25, 26, 27, as shown. Alternatively the fourth coolant circuit 28 can be connected upstream of the bypass circuit 24 and downstream of the parallel circuits 25, 26, 27. The third coolant circuit 23 comprises a controllable valve 40. This controllable valve 40 is open while the thermostat 32 is closed, in order to assist in heating the engine oil, and is closed when the thermostat 32 opens, in order to increase the oil temperature towards a desired operating temperature. By heating the engine oil, friction in the engine is reduced, fuel economy is improved and oil dilution, i.e., fuel and combustion products leaking past the piston rings, is reduced. For diesel engines it is also possible to speed up the diesel oxidation catalyst (DOC) light-off. The DOC promotes oxidation of several exhaust gas components by oxygen, which is present in diesel exhaust. When passed over an oxidation catalyst, diesel pollutants, such as carbon monoxide (CO), gas phase hydrocarbons (HC) and organic fraction of diesel particulates (SOF) can be oxidized to harmless products.

As described above, each parallel circuit is provided with a heat exchanger and a throttle valve. In FIG. 2A all throttle valves are shown as fixed flow valves pre-set to balance the coolant flow through the first throttle valve 34 and through each parallel circuit 25, 26, 27. The flow rate is determined by the heating and cooling requirements for each respective component connected to a respective heat exchanger 45, 46, 47 in a parallel circuit.

Alternatively, at least one throttle valve is a controllable flow valve arranged to balance the coolant flow through the first throttle valve and the at least one parallel circuit. In this case, the first throttle valve in the second coolant circuit and/or each throttle valve in a parallel circuit can be adjusted in steps or continuously to adapt the flow rate for the first throttle valve and each individual heat exchanger dependent on the current heating or cooling requirements for each respective component connected to a heat exchanger.

The cooling system 20 shown in FIG. 2A further comprises a heater 51 for the passenger compartment. Coolant can be directed from the engine 30, through a controllable valve 52 to the heater 51, before being returned to the second coolant circuit 22 upstream of the coolant pump 33 and downstream of the first throttle valve 34. A portion of the coolant drawn from the engine 30 towards the heater 51 can be passed through a de-gassing unit 53 and be returned to the second coolant circuit 22 upstream of the coolant pump 33 and downstream of the return flow from the heater 51.

Figure 2B:
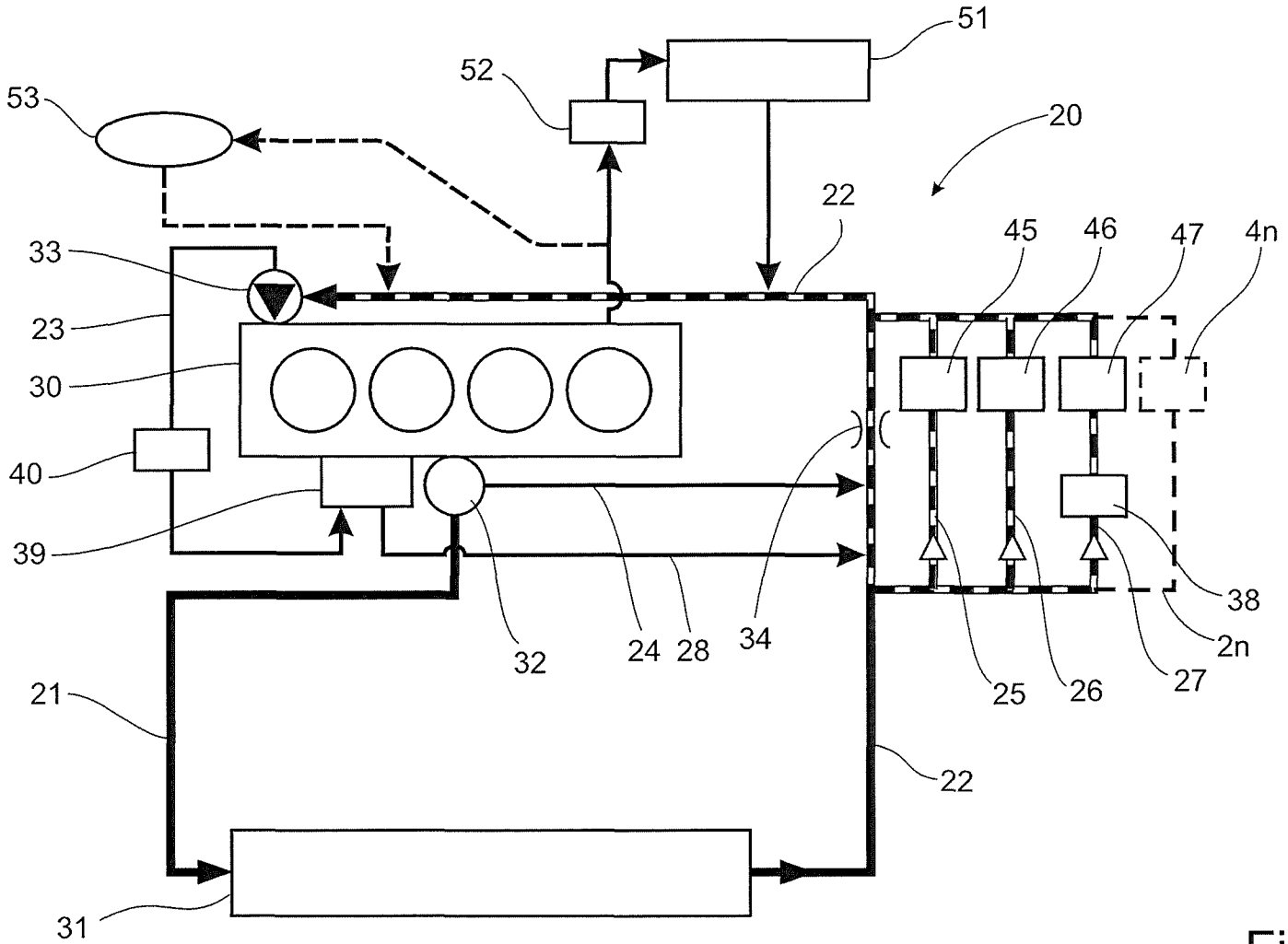
FIG. 2B shows an alternative version of the engine cooling system in FIG. 2A.

FIG. 2B shows an alternative version of the engine cooling system in FIG. 2A. The engine cooling system in FIG. 2B substantially identical to the example described in FIG. 2A and uses the same reference numerals for corresponding components.

As in the cooling system shown in FIG. 2A, the cooling system 20 in FIG. 2B comprises a number of parallel circuits 25, 26, 27, 2*n*, each comprising a heat exchanger 45, 46, 47, 4*n*, respectively, arranged for selectively heating or cooling a powertrain component (not shown). Each parallel circuit 25, 26, 27, 2*n* is connected to the second coolant circuit 22 at a common location upstream of the bypass circuit 24 and downstream of the first throttle valve 34. While the thermostat is closed, a partial coolant flow is directed from the bypass circuit 24 and upstream through the second coolant circuit 22 into the parallel circuits 25, 26, 27, 2*n* during engine warm-up. The throttle valve 34 in the secondary circuit 22 will restrict the coolant flow from the bypass circuit 24 and force a part of the coolant flow through the parallel circuits 25, 26, 27, 2*n*. This arrangement causes a reverse flow over a portion of the second coolant circuit 22, between the connection with the bypass circuit 24 and the connection of the parallel circuits 25, 26, 27, 2*n*. This counter flow prevents cold coolant in the second coolant circuit 22 in or downstream of the radiator 31 and upstream of the parallel circuits 25, 26, 27, 2*n* from being drawn towards the coolant pump 33 and the engine 30. The coolant flow in the second coolant circuit 22 and the parallel circuits 25, 26, 27 during engine warm-up is indicated with dashed lines in the respective circuit. The coolant flowing through the parallel circuits 25, 26, 27, 2*n* is returned to the second coolant circuit 22 downstream of the first throttle valve 34.

The cooling system 20 in FIG. 2B differs from the cooling system in FIG. 2A in that, each parallel circuit is provided with a heat exchanger without an associated throttle valve (see FIG. 2A; "35, 36, 37, 3*n*"). Instead of using throttle valves, the dimensions of each parallel circuit 25, 26, 27 is selected to balance the coolant flow through the second coolant circuit 22 upstream of the bypass circuit and the parallel circuits 25, 26, 27. For instance, if a heat exchanger 45 in a first parallel circuit 25 requires a greater coolant flow than the heat exchangers 46, 47 in the other parallel circuits 26, 27 then the conduit making up the first parallel circuit 25 is given a larger cross-section to allow a greater flow rate through that parallel circuit. In this way, the cross-section of the conduits in each parallel circuit can be dimensioned to the requirements of each associated heat exchanger. This arrangement allows for increased heating of the heat exchangers during start-up while providing increased cooling after the thermostat has opened. An advantage of the system shown in FIG. 2B is that the flow resistance through the parallel circuits can be reduced.

Figure 3:
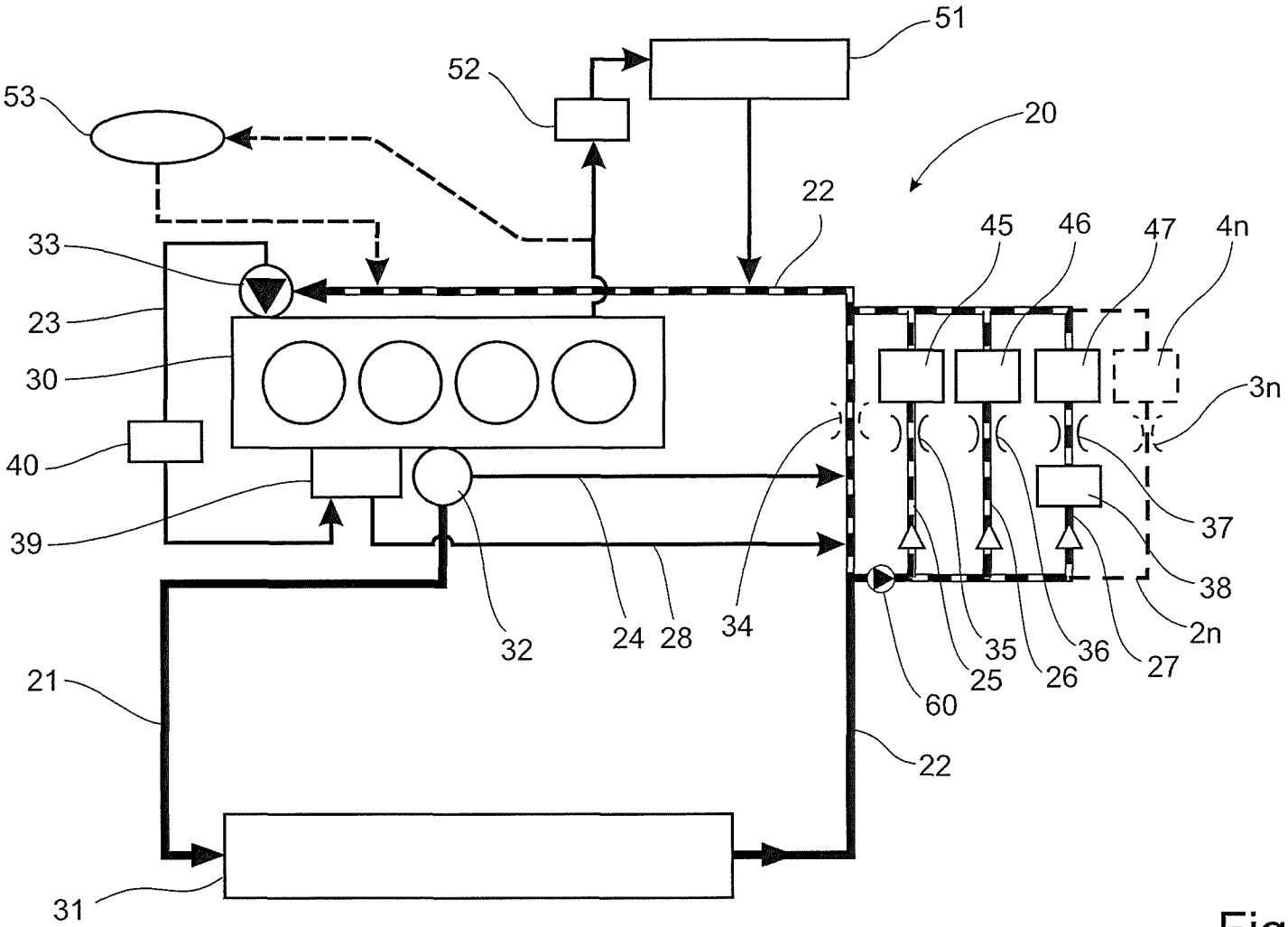
FIG. 3 shows a schematically illustrated first alternative example of an engine cooling system according to the disclosure.

FIG. 3 shows a schematically illustrated first alternative example of an engine cooling system according to the disclosure. The engine cooling system in FIG. 3 substantially identical to the example described in FIG. 2A and uses the same reference numerals for corresponding components.

The first alternative example differs from the engine cooling system described in FIG. 2A in that it further comprises a second coolant pump 60 arranged to control the coolant flow through the at least one parallel circuit 25, 26, 27. The second coolant pump 60 is a controllable pump located in the inlet of the at least one parallel circuit 25, 26, 27 adjacent the connection of the parallel circuit 25, 26, 27 to the second coolant circuit 22. In this way the flow rate through each parallel circuit 25, 26, 27 is controllable by a throttle valve 35, 36, 37 in the respective parallel circuit and by controlling the second coolant pump 60. The provision of a coolant pump for the at least one parallel circuit makes the first throttle valve 34 (indicated in dashed lines) in the second coolant circuit 22 optional.

Figure 4:
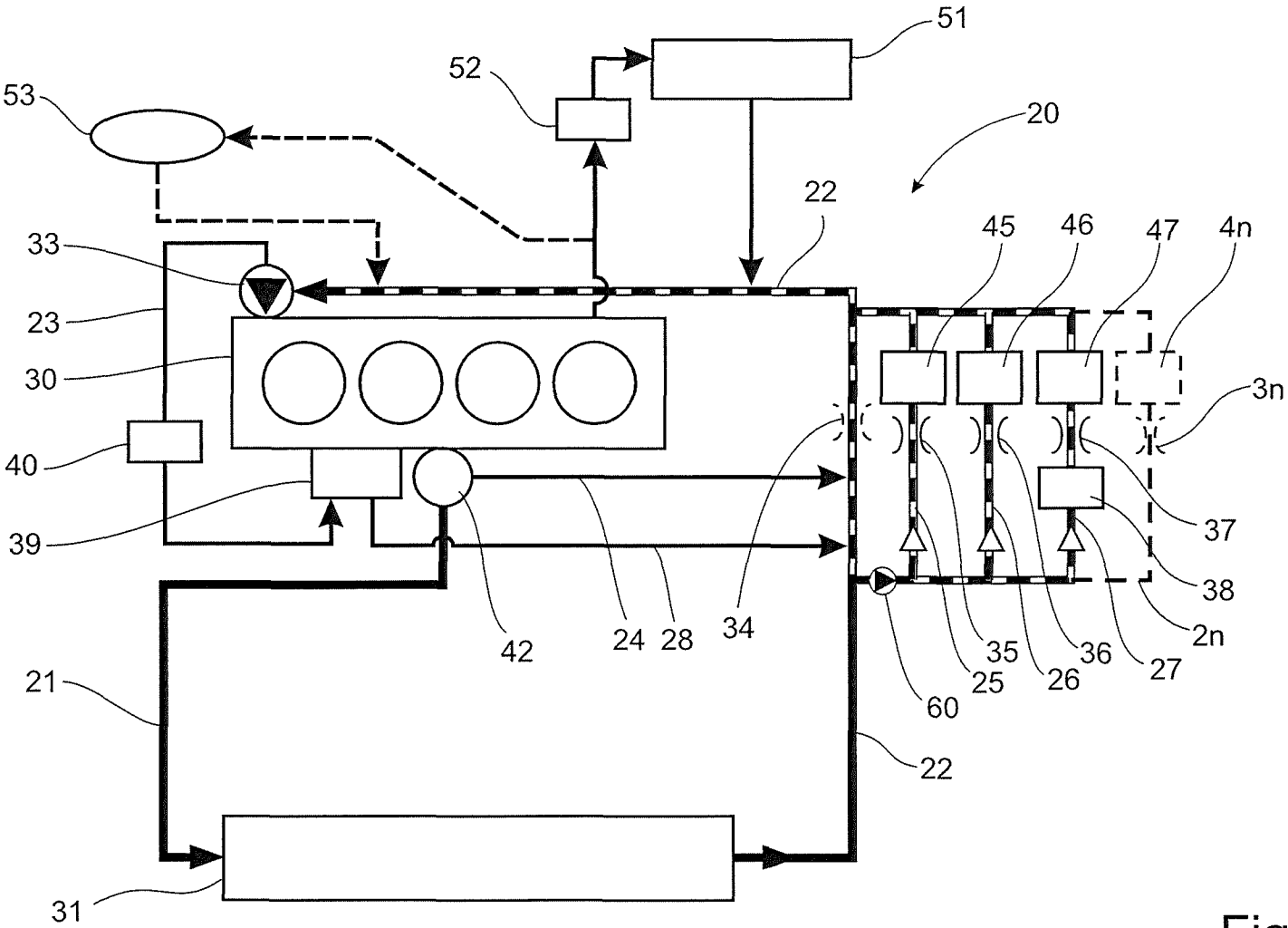
FIG. 4 shows a schematically illustrated second alternative example of an engine cooling system according to the disclosure.

FIG. 4 shows a schematically illustrated second alternative example of an engine cooling system according to the disclosure. The engine cooling system in FIG. 4 substantially identical to the example described in FIG. 3 and uses the same reference numerals for corresponding components.

The second alternative example differs from the engine cooling system described in FIG. 3 in that it further comprises a controllable thermostat 42 in the first coolant circuit 21 connecting the coolant outlet of the engine to the radiator 31. As the temperature of the coolant leaving the engine 30 increases towards a desired coolant temperature, the thermostat 42 is be partially opened to provide a leakage flow through the radiator 31. This will provide the EGR heat exchanger 45 with cold coolant from the relatively cold portion of the coolant circuit comprising the first coolant circuit 21, the radiator 31 and the portion of the second coolant circuit 22 upstream of the parallel circuits 25, 26, 27. In this way the NOx-emissions from the engine exhaust can be reduced when the engine 30 approaches its normal operating temperature. The controllable thermostat 42 will subsequently be gradually opened as the coolant temperature increases, until it is fully open at its predetermined set temperature. The set temperature of the thermostat can later be adjusted up or down dependent on current cooling requirements.

This second example is preferably, but not necessarily, combined with a second coolant pump 42 as described in the first alternative example in FIG. 3. The provision of a second coolant pump 42 allows the flow rate through the EGR heat exchanger 45 to be controlled accurately.

Figure 5:
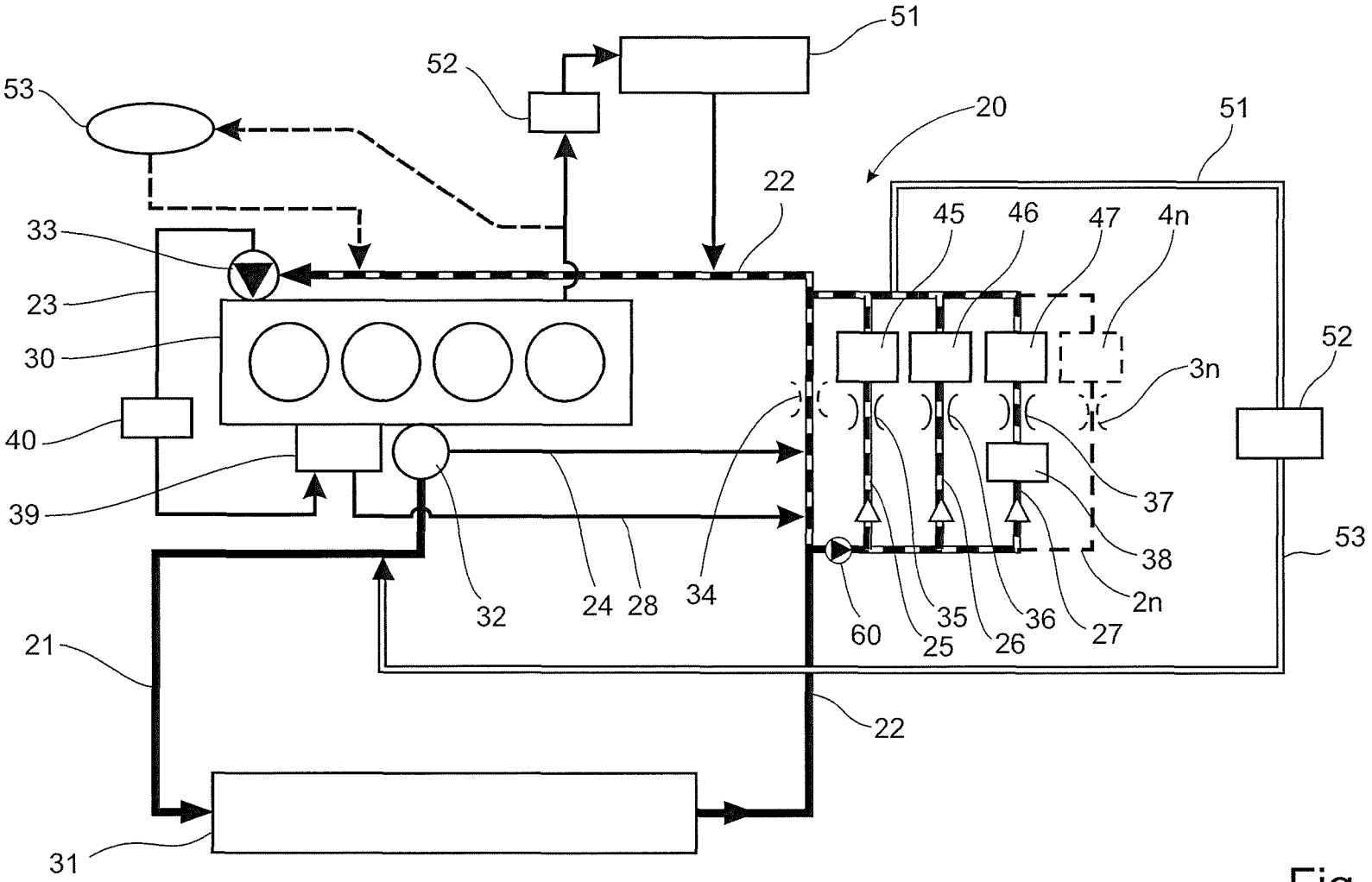
FIG. 5 shows a schematically illustrated third alternative example of an engine cooling system according to the disclosure.

FIG. 5 shows a schematically illustrated third alternative example of an engine cooling system according to the disclosure. The engine cooling system in FIG. 5 substantially identical to the example described in FIG. 3 and uses the same reference numerals for corresponding components.

The third alternative example differs from the engine cooling system described in FIG. 3 in that it further comprises a an alternative coolant return circuit 51, 52, 53. The alternative coolant return circuit 51, 52, 53 comprises a first return circuit 51 connected to the parallel circuits 25, 26, 27 downstream of the respective heat exchanger 45, 46, 47, a controllable valve 52, and a second return circuit 52 connected to the first coolant circuit 21 downstream of the thermostat 32 and upstream of the radiator 31. The coolant return circuit 51, 52, 53 bypasses the second coolant circuit 22 and the coolant pump 33 and returns a partial coolant flow from the parallel circuits 25, 26, 27 to the first coolant circuit 21. The controllable valve 52 can be opened prior to the opening of the thermostat to provide a leakage flow through the radiator 31 towards the parallel circuits 25, 26, 27. The valve 52 can be either a fixed flow valve or a controllable flow valve. This will provide the EGR heat exchanger 45 with cold coolant from the relatively cold portion of the coolant circuit comprising the first coolant circuit 21, the radiator 31 and the portion of the second coolant circuit 22 upstream of the parallel circuits 25, 26, 27. In this way the NOx-emissions from the engine exhaust can be reduced when the engine 30 approaches its normal operating temperature. This third example shown in FIG. 5 provides an alternative to the second alternative example shown in FIG. 4, wherein the alternative coolant return circuit 51, 52, 53 replaces a controllable thermostat 42.

Figure 6:
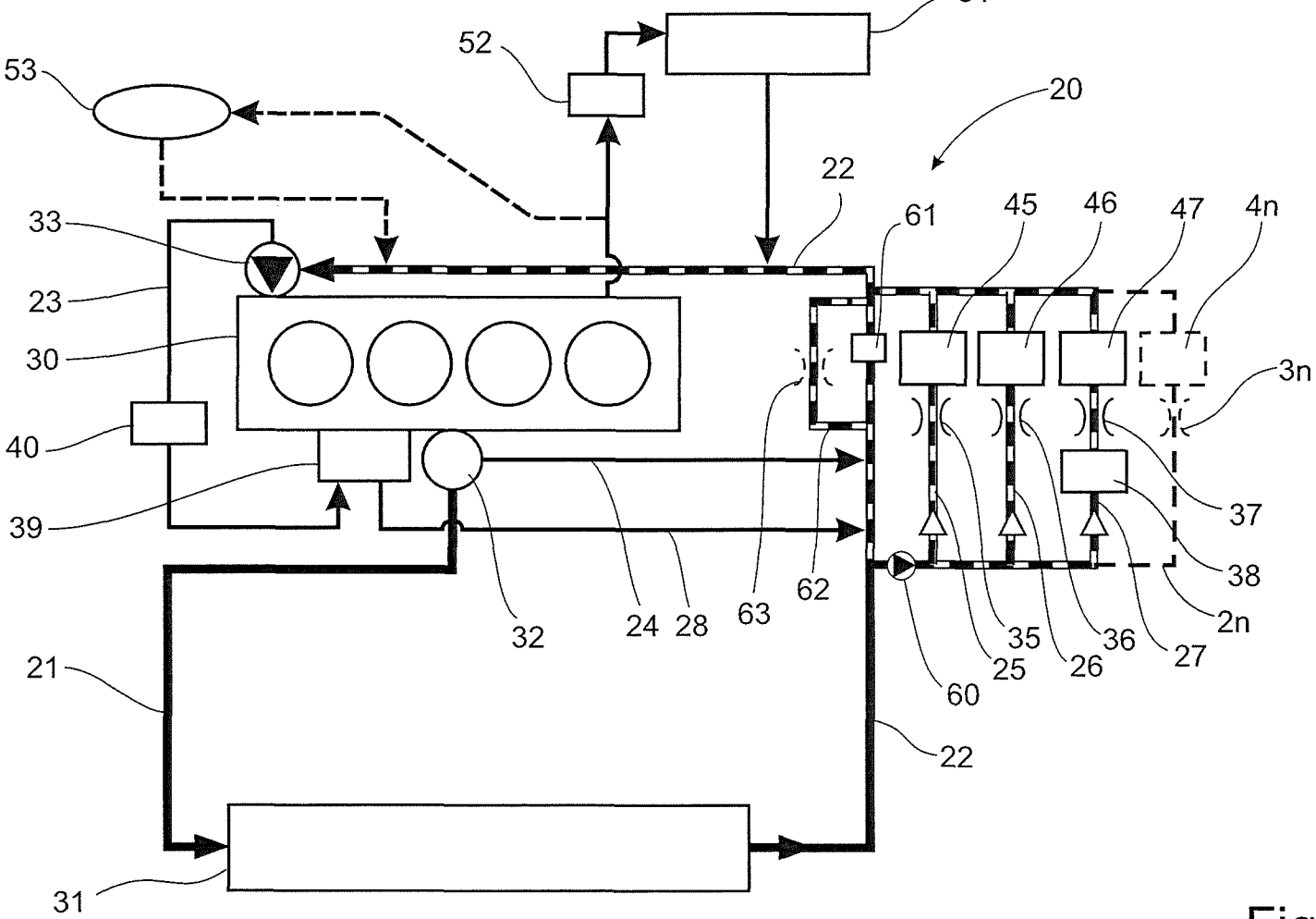
FIG. 6 shows a schematically illustrated third alternative example of an engine cooling system according to the disclosure.

FIG. 6 shows a schematically illustrated third alternative example of an engine cooling system according to the disclosure. The engine cooling system in FIG. 6 substantially identical to the example described in FIG. 2A and uses the same reference numerals for corresponding components.

The third alternative example differs from the engine cooling system described in FIG. 2A in that it comprises an alternative flow controlling device 61, 62, 63, replacing the first throttle valve 34 in the second coolant circuit 22 downstream of the bypass circuit 24. The alternative flow controlling device 61, 62, 63 comprises a controllable valve 61 with a reduced flow bypass circuit 62. During a cold start, the controllable valve is closed and a partial coolant flow is directed through the reduced flow bypass circuit, which circuit has the same function as the first throttle valve 34 described in FIG. 2A above. The flow restriction function can be achieved either by the use of a throttle valve 63 (shown in dashed lines) or by a conduit having a reduced cross-sectional area suitable for reducing the flow rate in the bypass circuit 62. In operation, when the engine 30 reaches its desired operating temperature, when the thermostat 32 opens, and/or when a predetermined operation condition is fulfilled, the valve can be opened to allow full flow of coolant through the second coolant circuit 22.

This fourth example can be combined with a second coolant pump 60 (shown in dashed lines) as described in the first alternative example shown in FIG. 3. The provision of a second coolant pump 60 allows at least a minimum flow rate through at least the EGR heat exchanger 45 to be maintained even if the valve 61 in the second coolant circuit 22 is fully open.

It is to be understood that the present disclosure is not limited to the embodiments described above and illustrated in the drawings; rather, the skilled person will recognize that many changes and modifications may be made within the scope of the appended claims. Additionally, the features of various implementing embodiments may be combined to form further embodiments of according to the disclosure.

What is claimed is:

1. An engine cooling system for a vehicle having an engine, the cooling system comprising:

a first coolant circuit for connecting a coolant outlet of the engine to a radiator;

a thermostat arrangeable in the first coolant circuit, the thermostat configured to be opened when a predetermined first coolant temperature is reached;

a second coolant circuit for connecting the radiator to a coolant inlet of the engine;

a coolant pump for circulating coolant through the cooling system;

a bypass circuit for connecting the thermostat to the second coolant circuit;

at least one parallel circuit comprising a heat exchanger, wherein each parallel circuit is configured to be connected to the second coolant circuit upstream of the bypass circuit relative to a normal direction of coolant flow when the thermostat is open;

a flow controlling device arrangeable to direct a reversed partial coolant flow from the bypass circuit into the at least one parallel circuit, such that the reversed partial coolant flow is directed from the bypass circuit and upstream through the second coolant circuit into the at least one parallel circuit when the thermostat is closed during engine warm-up.

2. The engine cooling system according to claim 1 wherein at least one parallel circuit comprises a fixed flow or controllable flow throttle valve.

3. The engine cooling system according to claim 1 wherein the flow controlling device is a flow restricting device arrangeable to limit flow rate in the second coolant circuit downstream of the bypass circuit.

4. The engine cooling system according to claim 3 wherein the flow restricting device is a fixed flow or controllable flow throttle valve.

5. The engine cooling system according to claim 3 wherein the flow restricting device is provided with a bypass circuit comprising a controllable valve.

6. The engine cooling system according to claim 4 wherein the flow restricting device is provided with a bypass circuit comprising a controllable valve.

7. The engine cooling system according to claim 1 wherein the flow controlling device is a second coolant pump arrangeable upstream of the bypass circuit.

8. The engine cooling system according to claim 1 wherein the thermostat is controllable in between its open and closed positions and is configured to be partially opened when a predetermined second coolant temperature is reached, which second coolant temperature is lower than the first coolant temperature.

9. The engine cooling system according to claim 1 wherein the flow controlling device comprises a controllable valve with a reduced flow bypass circuit, which controllable valve is configured to be opened when a predetermined operation condition is fulfilled.

10. A method for controlling an engine cooling system, wherein the engine cooling system comprises a first coolant circuit connecting a coolant outlet of an engine to a radiator, a thermostat arranged in the first coolant circuit and configured to be closed if coolant temperature is below a predetermined limit, a second coolant circuit connecting the radiator to a coolant inlet of the engine, and a coolant pump for circulating coolant through the cooling system, the method comprising, during engine warm-up:

maintaining the thermostat in a closed position, wherein the thermostat is configured to be opened when a predetermined first coolant temperature is reached;

supplying coolant flow through a bypass circuit when the thermostat is closed, wherein the bypass circuit connects the thermostat to the second coolant circuit;

maintaining a partial coolant flow from the bypass circuit and downstream through the second coolant circuit; and when the thermostat is closed, maintaining a reversed partial coolant flow directed from the bypass circuit and upstream through the second coolant circuit into at least one parallel circuit comprising a heat exchanger, the at least one parallel circuit being connected to the second coolant circuit upstream of the bypass circuit relative to a normal direction of coolant flow when the thermostat is open.

11. The method according to claim 10 wherein maintaining the partial coolant flow directed into the at least one parallel circuit comprises using a flow restricting device arranged to limit flow rate downstream of the bypass circuit.

12. The method according to claim 10 wherein maintaining the partial coolant flow directed into the at least one parallel circuit comprises using a second coolant pump upstream of the bypass circuit.

13. The method according to claim 10 further comprising controlling the thermostat by partially opening it when a predetermined second coolant temperature is reached, which second coolant temperature is lower than the first coolant temperature.

14. The method according to claim 10 wherein the engine cooling system comprises a flow controlling device configured to enable the partial coolant flow from the bypass circuit into the at least one parallel circuit, wherein the flow controlling device comprises a controllable valve with a reduced flow bypass circuit, and wherein the controllable valve is opened when a predetermined operation condition is fulfilled.

15. The method according to claim 10 further comprising controlling the coolant flow in at least one parallel circuit using a fixed flow or controllable flow throttle valve.

16. A vehicle comprising:

an engine having a coolant inlet and a coolant outlet;

a radiator; and an engine cooling system comprising:

a first coolant circuit that connects the coolant outlet of the engine to the radiator;

a thermostat arranged in the first coolant circuit and configured to be opened when a predetermined first coolant temperature is reached;

a second coolant circuit that connects the radiator to the coolant inlet of the engine;

a coolant pump for circulating coolant through the cooling system;

a bypass circuit connected to the thermostat and the second coolant circuit;

at least one parallel circuit, each parallel circuit comprising a heat exchanger and being connected to the second coolant circuit upstream of the bypass circuit relative to a normal direction of coolant flow when the thermostat is open; and a flow controlling device arranged to direct a reversed partial coolant flow from the bypass circuit into the at least one parallel circuit, such that the reverse partial coolant flow is directed from the bypass circuit and upstream through the second coolant circuit into the at least one parallel circuit when the thermostat is closed during engine warm-up.

17. The vehicle according to claim 16 wherein at least one parallel circuit of the at least one parallel circuit comprises a fixed flow or controllable flow throttle valve.

18. The vehicle according to claim 16 wherein the flow controlling device of the engine cooling system is a flow restricting device arranged to limit flow rate in the second coolant circuit downstream of the bypass circuit.

19. The vehicle according to claim 18 wherein the flow restricting device is a fixed flow or controllable flow throttle valve.

20. The vehicle according to claim 18 wherein the flow restricting device is provided with a bypass circuit comprising a controllable valve.

* * * * *